US009861258B2

(12) United States Patent
Beshears, Jr. et al.

(10) Patent No.: US 9,861,258 B2
(45) Date of Patent: Jan. 9, 2018

(54) DISHWASHER

(71) Applicant: Whirlpool Corporation, Benton Harbor, MI (US)

(72) Inventors: Paul E. Beshears, Jr., Stevensville, MI (US); Kaustav Ghosh, Benton Harbor, MI (US); James W. Klein, Kalamazoo, MI (US); Scott D. Slabbekoorn, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 153 days.

(21) Appl. No.: 14/071,902

(22) Filed: Nov. 5, 2013

(65) Prior Publication Data

US 2014/0261585 A1 Sep. 18, 2014

Related U.S. Application Data

(60) Provisional application No. 61/786,757, filed on Mar. 15, 2013.

(51) Int. Cl.
*A47L 15/44* (2006.01)

(52) U.S. Cl.
CPC ..... *A47L 15/449* (2013.01); *A47L 15/4463* (2013.01); *A47L 2401/22* (2013.01)

(58) Field of Classification Search
CPC ..... D06F 33/02; D06F 39/02; D06F 39/088; D06F 39/005; D06F 39/022; D06F 39/024; D06F 39/026; D06F 39/028; D06F 39/083; D06F 39/10; D06F 2204/02; D06F 2204/088; D06F 2204/086; D06F 2202/02; A47L 15/0055; A47L 15/4463; A47L 15/449; A47L 15/4418; A47L 15/4445; A47L 15/44; A47L 15/4214; A47L 15/4217; A47L 15/4236
USPC .... 134/10, 18, 56 D, 93, 99.2, 102.2, 104.1, 134/115 R, 57 D, 94.1, 95.3; 225/25, 1, 225/52, 505, 63
See application file for complete search history.

(56) References Cited

U.S. PATENT DOCUMENTS 3,324,796 A * 6/1967 Laflame ..... A47L 15/4225 134/186
5,195,338 A * 3/1993 Russo ..... D06F 39/022 222/651
5,848,610 A * 12/1998 Livernash et al. ..... 137/625.11
6,701,944 B2 3/2004 McNabb et al.
(Continued)

FOREIGN PATENT DOCUMENTS

DE 1628517 A1 2/1971
DE 3701404 A1 8/1987
(Continued)

OTHER PUBLICATIONS

European Search Report for Corresponding EP14158636.2, dated Jun. 4, 2014.

*Primary Examiner* — Michael Barr
*Assistant Examiner* — Tinsae Ayalew
(74) *Attorney, Agent, or Firm* — McGarry Bair PC

(57) ABSTRACT

A dishwasher has a treating chamber for receiving dishes for treatment according to an automatic cycle of operation and a dispensing system for storing and dispensing treating chemistry to the treating chamber during the cycle of operation. The dishwasher can be provided with a lifetime supply of a treating chemistry for the dispensing system.

20 Claims, 6 Drawing Sheets

(56) References Cited

U.S. PATENT DOCUMENTS

| | | | | |
|---|---|---|---|---|
| 7,398,787 | B2 | 7/2008 | Hsu et al. | |
| 7,445,013 | B2 | 11/2008 | Vanderroest et al. | |
| 7,523,758 | B2 | 4/2009 | Vanderroest et al. | |
| 7,654,421 | B2 | 2/2010 | Chan et al. | |
| 7,789,967 | B2 | 9/2010 | Classen et al. | |
| 7,950,088 | B2 | 5/2011 | Dalton et al. | |
| 2002/0088502 | A1 | 7/2002 | Van Rompuy et al. | |
| 2002/0153389 | A1* | 10/2002 | Creaghan et al. | 222/190 |
| 2003/0116177 | A1 | 6/2003 | Appel et al. | |
| 2004/0180807 | A1* | 9/2004 | Song et al. | 510/521 |
| 2006/0060229 | A1 | 3/2006 | Gonska et al. | |
| 2009/0194562 | A1 | 8/2009 | Kessler et al. | |
| 2010/0000578 | A1* | 1/2010 | Hendrickson | D06F 39/022 134/34 |
| 2010/0083990 | A1 | 4/2010 | Classen et al. | |
| 2010/0108105 | A1 | 5/2010 | Classen et al. | |
| 2011/0174346 | A1 | 7/2011 | Kessler et al. | |
| 2011/0214702 | A1* | 9/2011 | Brown-West et al. | 134/198 |
| 2012/0017953 | A1 | 1/2012 | Fileccia et al. | |

FOREIGN PATENT DOCUMENTS

| | | | | |
|---|---|---|---|---|
| DE | 3903636 | A1 | 8/1990 | |
| DE | 10039408 | A1 | 12/2001 | |
| DE | 10058460 | A1 | 5/2002 | |
| DE | 102006043915 | A1 | 3/2008 | |
| DE | 102008036588 | A1 | 2/2010 | |
| DE | 102010003773 | A1 | 10/2011 | |
| EP | 0379665 | A1 | 8/1990 | |
| EP | 0516555 | A2 * | 12/1992 | C11D 3/06 |
| EP | 2324151 | B1 | 5/2011 | |
| GB | 2134078 | A | 8/1984 | |
| WO | 0220893 | A1 | 3/2002 | |

* cited by examiner

DISHWASHER

CROSS-REFERENCE TO RELATED APPLICATION

This application claims the benefit of U.S. Provisional Patent Application No. 61/786,757, filed Mar. 15, 2013, which is incorporated herein by reference in its entirety.

BACKGROUND OF THE INVENTION

Contemporary automatic dishwashers for use in a home typically include a dispenser for automatically dispensing one or more treating chemistries at an appropriate time during a cycle of operation. One common type of dispenser is the manual or single-use dispenser, which can be provided with only enough treating chemistry for a single cycle. These single-use dispensers need to be provided with treating chemistry by a user prior to each cycle of operation. Another type of dispenser is the bulk dispenser, which can be provided with enough treating chemistry for multiple cycles, and which is configured to dispense a dose of treating chemistry from the bulk supply during a cycle of operation. After a number of cycles have been run, the bulk dispenser requires refilling.

BRIEF DESCRIPTION OF THE INVENTION

The invention relates to an apparatus including a dishwasher for treating dishes according to an automatic cycle of operation, the dishwasher comprising a chassis defining an interior, a tub located within the interior and at least partially defining a treating chamber for receiving dishes for treatment according to the cycle of operation, a lifetime supply reservoir storing a predetermined number of doses of treating chemistry, and a dispensing system fluidly coupled with the treating chamber and the lifetime supply reservoir, and supplying a dose of treating chemistry to the treating chamber from the lifetime supply reservoir during the cycle of operation, wherein the lifetime supply reservoir is located within the interior such that it is inaccessible to a user of the dishwasher and wherein the predetermined number of doses is based on an expected lifetime of the dishwasher.

DESCRIPTION OF EMBODIMENTS OF THE INVENTION

The invention is generally directed toward the supply of treating chemistry in a dishwasher. The particular approach of the invention is to provide a treating chemistry reservoir with a lifetime supply of treating chemistry that is concealed from the user of the dishwasher, and which is not accessible or refillable by the user.

Figure 1:
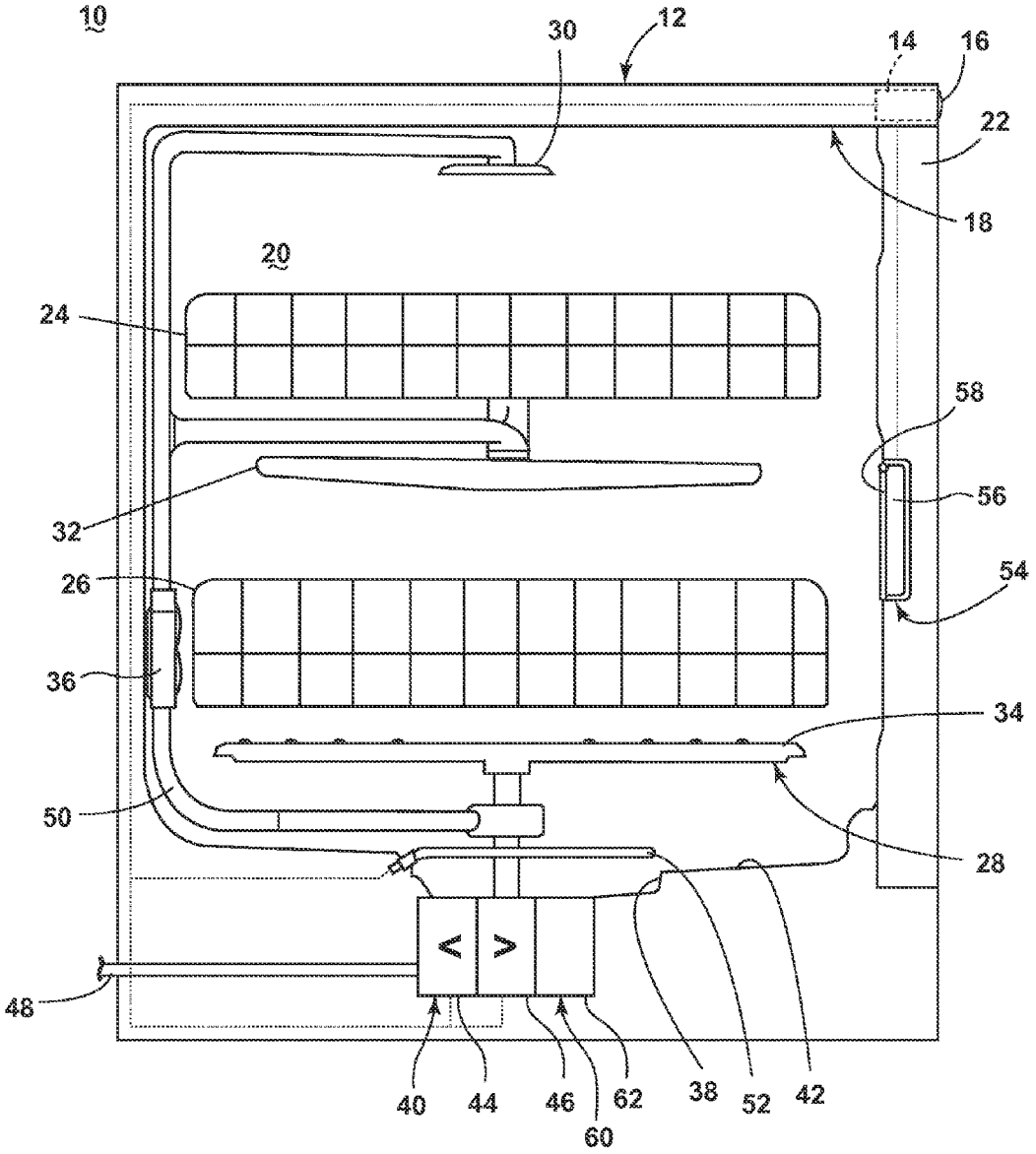
FIG. 1 is a schematic, side view of a dishwasher according to one embodiment of the invention.

FIG. 1 is a schematic, side view of a dishwasher 10 according to one embodiment of the invention. In FIG. 1, the dishwasher 10 includes a chassis 12 defining an interior. Depending on whether the dishwasher 10 is a stand-alone or built-in dishwasher, the chassis 12 may be a frame with or without panels attached, respectively. The dishwasher 10 shares many features of a conventional automatic dishwasher, which will not be described in detail herein except as necessary for a complete understanding of the invention. While the present invention is described in terms of a conventional dishwashing unit, it could also be implemented in other types of dishwashing units, such as in-sink dishwashers, multi-tub dishwashers, or drawer-type dishwashers.

A controller 14 may be located within the chassis 12 and may be operably coupled with various components of the dishwasher 10 to implement one or more cycles of operation. A control panel or user interface 16 may be provided on the dishwasher 10 and coupled with the controller 14. The user interface 16 may include operational controls such as dials, lights, switches, and displays enabling a user to input commands, such as a cycle of operation, to the controller 14 and receive information.

A tub 18 is located within the interior of the chassis 12 and at least partially defines a treating chamber 20 with an access opening in the form of an open face. A cover, illustrated as a door 22, may be hingedly mounted to the chassis 12 and may move between an opened position, wherein the user may access the treating chamber 20, and a closed position, as shown in FIG. 1, wherein the door 22 covers or closes the open face of the treating chamber 20.

Dish holders in the form of upper and lower racks 24, 26 are located within the treating chamber 20 and receive dishes for being treated. The racks 24, 26 are mounted for slidable movement in and out of the treating chamber 20 for ease of loading and unloading. As used in this description, the term "dish(es)" is intended to be generic to any item, single or plural, that may be treated in the dishwasher 10, including, without limitation; dishes, plates, pots, bowls, pans, glassware, silverware, and other utensils. While not shown, additional dish holders, such as a silverware basket on the interior of the door 22 or a third level rack above the upper rack 24 may also be provided.

A spraying system 28 may be provided for spraying liquid into the treating chamber 20 and is illustrated in the form of an upper sprayer 30, a mid-level sprayer 32, a lower rotatable spray arm 34, and a spray manifold 36. The upper sprayer 30 may be located above the upper rack 24 and is illustrated as a fixed spray nozzle that sprays liquid downwardly within the treating chamber 20. Mid-level rotatable sprayer 32 and lower rotatable spray arm 34 are located, respectively, beneath upper rack 24 and lower rack 26 and are illustrated as rotating spray arms. The mid-level spray arm 32 may provide a liquid spray upwardly through the bottom of the upper rack 24. The lower rotatable spray arm 34 may provide a liquid spray upwardly through the bottom of the lower rack 26. The mid-level rotatable sprayer 32 may optionally also provide a liquid spray downwardly onto the lower rack 26, but for purposes of simplification, this will not be illustrated herein.

The spray manifold 36 may be fixedly mounted to the tub 18 adjacent to the lower rack 26 and may provide a liquid spray laterally through a side of the lower rack 26. The spray manifold 36 may not be limited to this position; rather, the spray manifold 36 may be located in virtually any part of the treating chamber 20. While not illustrated herein, the spray manifold 36 may include multiple spray nozzles having apertures configured to spray wash liquid towards the lower rack 26. The spray nozzles may be fixed or rotatable with respect to the tub 18. Suitable spray manifolds are set forth in detail in U.S. Pat. No. 7,445,013, filed Jun. 17, 2003, and titled "Multiple Wash Zone Dishwasher," and U.S. Pat. No. 7,523,758, filed Dec. 30, 2004, and titled "Dishwasher Having Rotating Zone Wash Sprayer," both of which are incorporated herein by reference in their entirety.

A liquid recirculation system may be provided for recirculating liquid from the treating chamber 20 to the spraying system 28. The recirculation system may include a sump 38 and a pump assembly 40. The sump 38 collects the liquid sprayed in the treating chamber 20 and may be formed by a sloped or recess portion of a bottom wall 42 of the tub 18. The pump assembly 40 may include both a drain pump 44 and a recirculation pump 46. The drain pump 44 may draw liquid from the sump 38 and pump the liquid out of the dishwasher 10 to a household drain line 48. The recirculation pump 46 may draw liquid from the sump 38, and the liquid may be simultaneously or selectively pumped through a supply tube 50 to each of the spray assemblies 30, 32, 34, 36 for selective spraying.

While the pump assembly 40 is illustrated as having separate drain and recirculation pumps 44, 46 in an alternative embodiment, the pump assembly 40 may include a single pump configured to selectively supply wash liquid to either the spraying system 28 or the drain line 48, such as by configuring the pump to rotate in opposite directions, or by providing a suitable valve system. While not shown, a liquid supply system may include a water supply conduit coupled with a household water supply for supplying water to the sump 38.

A heating system having a heater 52 may be located within or near the sump 38 for heating liquid contained in the sump 38. A filtering system (not shown) may be fluidly coupled with the recirculation flow path for filtering the recirculated liquid.

A user-accessible dispensing system may be provided for storing and dispensing treating chemistry to the treating chamber 20. As shown herein, the user-accessible dispensing system can include a dispenser 54 mounted on an inside surface of the door 22 such that the dispenser 54 is disposed in the treating chamber 20 when the door 22 is in the closed position. The dispenser 54 is configured to dispense treating chemistry to the dishes within the treating chamber 20. The dispenser 54 can have one or more compartments 56 closed by a door 58 on the inner surface of the door 22. The dispenser 54 can be a single use dispenser which holds a single dose of treating chemistry, a bulk dispenser which holds a bulk supply of treating chemistry and which is adapted to dispense a dose of treating chemistry from the bulk supply during a cycle of operation, or a combination of both a single use and bulk dispenser. The dispenser 54 can further be configured to hold multiple different treating chemistries. For example, the dispenser 54 can have multiple compartments defining different chambers in which treating chemistries can be held. While shown as being disposed on the door 22, other locations of the dispenser 54 are possible. However, the dispenser 54 is positioned to be accessed by the user for refilling of the dispenser 54, whether it is necessary to refill the dispenser 54 before each cycle (i.e. for a single user dispenser) or only periodically (i.e. for a bulk dispenser).

The dishwasher 10 may further include a lifetime supply of a treating chemistry. The lifetime supply can be a predetermined number of doses of treating chemistry that is based on an expected lifetime of the dishwasher. By expected lifetime, it is meant the designed useful life of the appliance, which is typically quantified in years, number of cycles per year, or the total number of cycles the dishwasher 10 runs during the duration of its usefulness. If the dishwasher is expect to run a total of X cycles during its lifetime, then the lifetime supply of a treating chemistry can be equal to X doses of treating chemistry (i.e. enough for one dose per cycle). In one example, a dishwasher 10 with a lifetime of approximately 2,600 cycles (10 years×260 cycles per year) can be provided with 2,600 doses of treating chemistry.

A user-inaccessible dispensing system 60 may be provided for storing and dispensing the lifetime supply of treating chemistry to the treating chamber 20 and can include a lifetime supply reservoir, shown herein as a tank 62, which is inaccessible by the user. The supply tank 62 stores a lifetime supply of treating chemistry, and does not need to be refilled or replaced by the user so it can be hidden from view. The lifetime supply of treating chemistry differs from a bulk supply because a bulk supply still requires periodic refilling by the user. The lifetime supply is provided with the dishwasher 10, and never requires refilling by the user. In the following description, the treating chemistry is described as a rinse aid for illustrative purposes. However, it is understood that this invention may be applicable to other types of treating chemistry, including detergents, pre-wash detergents, and bleach.

In order to provide a lifetime supply, rinse aid can be formulated for long term storage and viability, including both dispensability and cleaning effectiveness, and may require formulation variations over current commercial rinse aids. One solution is to have a much more concentrated form of rinse aid that can be dispensed from the dispensing system 60 even after being stored for multiple years within the lifetime supply tank 62 and which remains stable with key rinsing performance characteristics. For example, the lifetime supply tank 62 can be filled with a rinse aid that has a concentration of at least 8-10 times an off-the-shelf rinse aid to define a super-concentrated wash aid, and which further is chemically stable for the lifetime of the dishwasher 10 (approximately 10 years) so that the rinse aid resists chemical change and decomposition. Current commercial formulations of rinse aid range from approximately 50 to 90% by weight of water. The super-concentrated rinse aid can have 45% or less by weight of water, with the remaining volume made up of one or more other components, such as solvents, hydrotropes, builders, surfactants, and chelators. More specifically, the super-concentrated rinse aid can have 0 to 25% by weight of water. Even more specifically, the super-concentrated rinse aid can have 10% or less by weight of water. By reducing the volume of water, the total volume of the lifetime supply tank 62 can be reduced, while still providing a rinse aid that works effectively to aid in drying and reducing water spots.

Because of the reduced concentration of water, the concentration of other solvents, such as ethyl alcohol, isopropyl alcohol, dipropylene glycol, and oligo- and other polyethylene glycol or mixtures thereof, correspondingly increase over concentrations found in current commercial formulations of rinse aid. Glycols, for example, are typically present at a level below 1% by weight in current commercial formulations of rinse aid. The super-concentrated rinse aid can have increased amounts of glycols, for example in the range of 100 to 800% over current levels, and more specifically in the range of 200 to 500% over current levels. Alcohols can be used, in addition to their current function as a solvent, for viscosity control during dispensing. Hydrotropes, such as sodium xylene sulfonate (SXS) or sodium cumene sulfonate (SCS) may also be increased, such as in a range of 100 to 800% over current levels. Builders for reducing pH to a moderate acidic range (ex: 4.0 to 6.5), such as citric acid or sodium succinate, would also require higher concentration levels. The bulk of current commercial formulations of rinse aid contain nonionic surfactant or surfactant mixtures typically in the range of 10 to 30% by weight. Examples of surfactants include, but are not limited to, Pluronics™ (block copolymers based on ethylene oxide and propylene oxide), Taxapon™ (sodium lauryl ether sulfate), Triton™ (octylphenol ethoxylate) and Dyropon™ (an ethylene oxide/propylene oxide fatty alcohol low foaming surfactant), all of which are available in the market today. The super-concentrated rinse aid can have one or more of these surfactant types at higher concentrations would produce a rinse aid that is dispensable over the anticipated lifetime of the dishwahser. Chelators such as Trilon M™ (methylglycinediacetic acid), ethylenediamine tetratacetic acid (EDTA) and homopolymers of acrylic such as Sokalon™ (a polyacrylic acid homopolymer.) and/or Tamol™ (naphthalenesulphonic acid) can also be used at higher concentrations, for example in the range of 200 to 800% over concentrations found in current commercial formulations of rinse aid.

Since the rinse aid is super-concentrated, the total volume of the lifetime supply tank 62 can be 1.0 L or less. In one example, a dishwasher 10 with a lifetime of approximately 2,600 cycles (10 years×260 cycles per year) can be provided with a lifetime supply tank 62 of approximately 0.8 L and configured to dose approximately 0.3 mL of rinse aid per cycle.

The lifetime supply tank 62 can be located underneath the bottom wall 42 of the treating chamber 20, such as by the sump 38. More specifically, the lifetime supply tank 62 can be in fluid communication with a conduit or hose extending between the sump 38 and the recirculation pump 46 so that rinse aid can be supplied directly to recirculating wash liquid. Other locations for the lifetime supply tank 62 include the door 22, within one of the walls defining the treating chamber 20, or outside the one of the walls defining the treating chamber 20, such as in the gap between the dishwasher 10 and the surrounding cabinetry.

Figure 2:
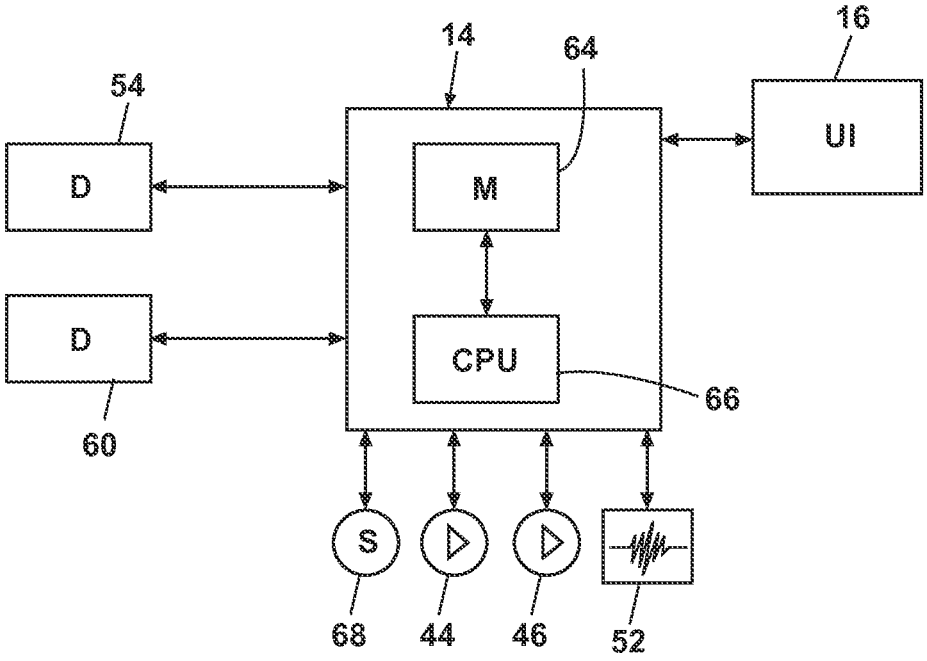
FIG. 2 is a schematic view of a controller of the dishwasher of FIG. 1.

FIG. 2 is a schematic view of the controller 14 of the dishwasher 10 of FIG. 1. As illustrated schematically in FIG. 2, the controller 14 may be coupled with the heater 52 for heating the wash liquid during a cycle of operation, the drain pump 44 for draining liquid from the treating chamber 20, the recirculation pump 46 for recirculating the wash liquid during the cycle of operation, the user-accessible dispenser 54 for selectively dispensing treating chemistry to the treating chamber 20, and the user-inaccessible dispensing system 60 for selectively dispensing rinse aid to the treating chamber 20. The controller 14 may be provided with a memory 64 and a central processing unit (CPU) 66. The memory 64 may be used for storing control software that may be executed by the CPU 66 in completing a cycle of operation using the dishwasher 10 and any additional software. For example, the memory 64 may store one or more preprogrammed cycles of operation that may be selected by a user and completed by the dishwasher 10. The controller 14 may also receive input from one or more sensors 68. Non-limiting examples of sensors 68 that may be communicably coupled with the controller 14 include a temperature sensor and turbidity sensor to determine the soil load associated with a selected grouping of dishes, such as the dishes associated with a particular area of the treating chamber 20.

Figure 3:
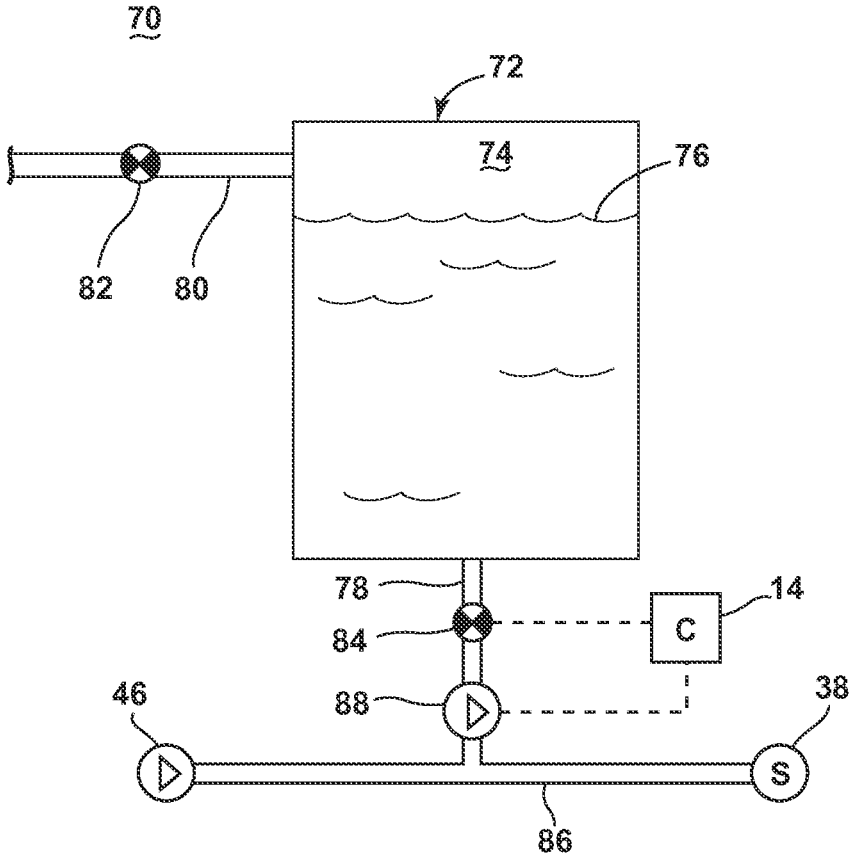
FIG. 3 is a schematic view of a dispensing system having a lifetime supply tank according to a second embodiment of the invention.

FIG. 3 is a schematic view of a dispensing system 70 having a lifetime supply reservoir, shown herein as a tank 72 according to a second embodiment of the invention. The dispensing system 70 can be used with the dishwasher 10 of FIGS. 1-2. In the second embodiment, the lifetime supply tank 72 is a sealed container defining an interior chamber 74 for rinse aid 76 and includes a chemistry outlet 78 for rinse aid 76 and an air inlet 80 with a selectively openable closure, such as a one-way check valve 82, that will let air into the chamber 74 as rinse aid 76 is dispensed. A metering valve 84 on the outlet 78 can be configured to meter a small amount (for example, approximately 0.3 mL) of rinse aid 76 during a selected part of a cycle of operation, via automatic control by the controller 14. The dispensing system 70 can be configured to dispense rinse aid 76 into a hose or conduit 86 extending between the sump 38 and the recirculation pump 46 so that rinse aid 76 can be supplied directly to recirculating wash liquid. A dispensing pump 88 is provided for moving rinse aid 76 to the conduit 86, and can also be coupled with the controller 14. Instead of being dispensed directly into the conduit 86, the rinse aid 76 can be dispensed into a staging chamber or holding area in fluid communication with the conduit 86.

Figure 4:
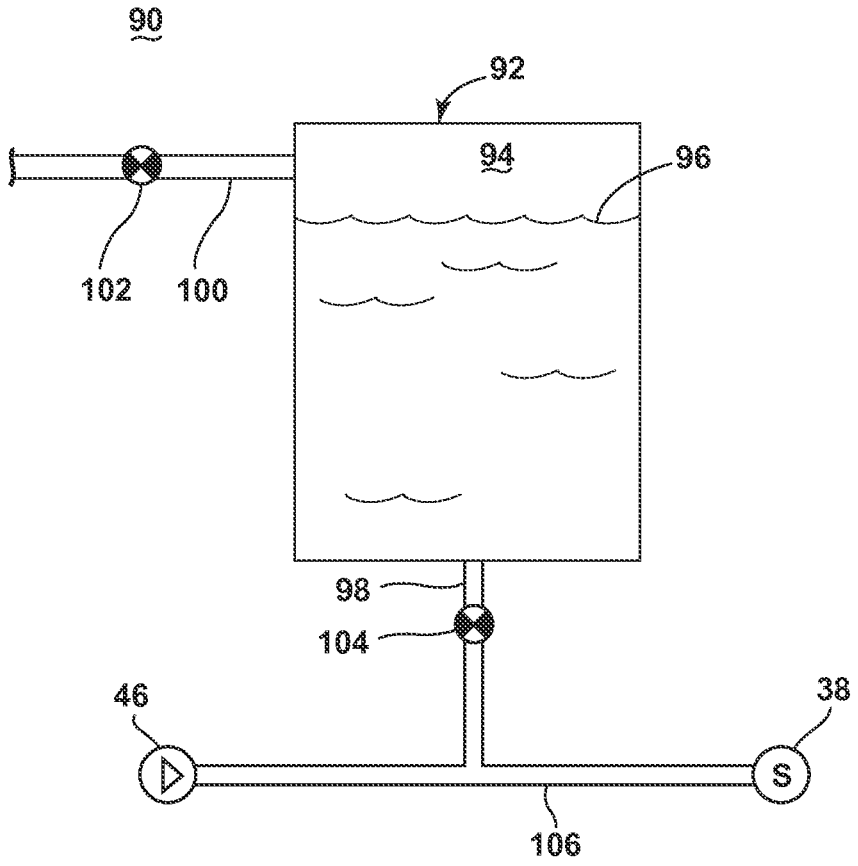
FIG. 4 is a schematic view of a dispensing system having a lifetime supply tank according to a third embodiment of the invention.

FIG. 4 is a schematic view of a dispensing system 90 having a lifetime supply reservoir, shown herein as a tank 92 according to a third embodiment of the invention. In the third embodiment, the lifetime supply tank 92 is a sealed container defining an interior chamber 94 for rinse aid 96 and includes a chemistry outlet 98 for rinse aid 96 and an air inlet 100 with a selectively openable closure, such as a one-way check valve 102, that will let air into the chamber 94 as rinse aid 96 is dispensed. A pressure-activated valve 94 on the outlet 98 can be configured to meter a small amount (for example, approximately 0.3 mL) of rinse aid 96 during a selected part of a cycle of operable. The dispensing system 90 can be configured to rely on a pressure change due to the temperature change that occurs when the cycle of operation is initiated. When a cycle of operation starts, heated water is supplied to the dishwasher 10, which increases the internal temperature of the dishwasher 10. Since the volume of the dishwasher 10 remains essentially constant, the pressure inside the dishwasher 10 will also increase. The increased pressure will open the valve 94 and push rinse aid 76 out of the chamber 94. The rinse aid 96 can be dispensed into a hose or conduit extending between the sump 38 and the recirculation pump 46 so that rinse aid 96 can be supplied directly to recirculating wash liquid. Alternatively, instead of being dispensed directly into the conduit 106, the rinse aid 96 can be dispensed into a staging chamber or holding area in fluid communication with the conduit 106.

Figure 5:
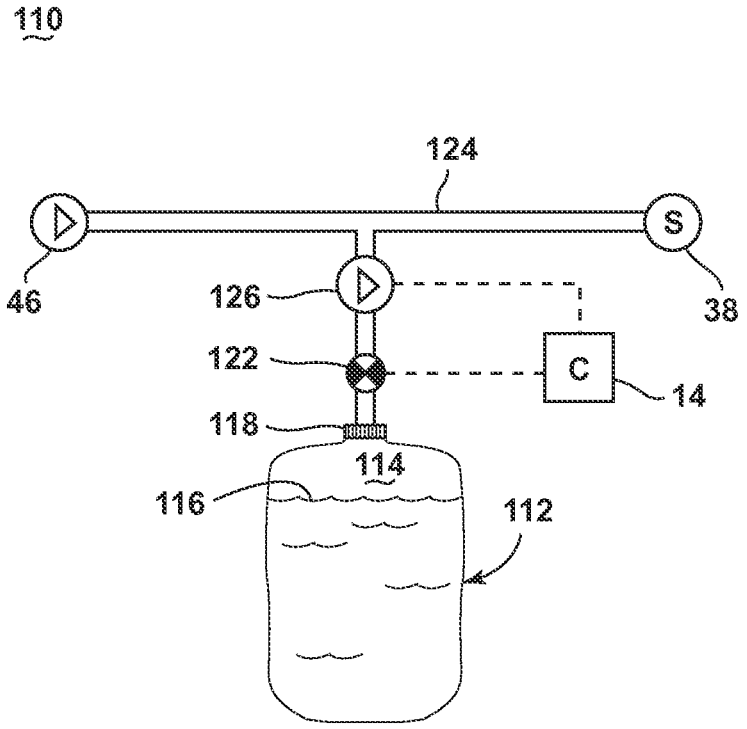
FIG. 5 is a schematic view of a dispensing system having a lifetime supply tank according to a fourth embodiment of the invention.

FIG. 5 is a schematic view of a dispensing system 110 having a lifetime supply reservoir, shown herein as a flexible container 112 according to a fourth embodiment of the invention. In the fourth embodiment, the container 112 is a sealed, collapsible container defining an interior chamber 114 for rinse aid 116 and includes a chemistry outlet 118 for rinse aid 116. A metering valve 122 on the outlet 118 can be configured to meter a small amount (for example, approximately 0.3 mL) of rinse aid 116 during a selected part of a cycle of operation, via automatic control by the controller 14. The dispensing system 110 can be configured to dispense rinse aid 116 into a hose or conduit 124 extending between the sump 38 and the recirculation pump 46 so that rinse aid 116 can be supplied directly to recirculating wash liquid. A dispensing pump 126 is provided for moving rinse aid 116 to the conduit 124, and can also be coupled with the controller 14. Instead of being dispensed directly into the conduit 124, the rinse aid 116 can be dispensed into a staging chamber or holding area in fluid communication with the conduit 124. As the volume of rinse aid 116 in the container 112 decreases, the container 112 collapses, thereby likewise reducing the volume of the interior chamber 114.

Figure 6:
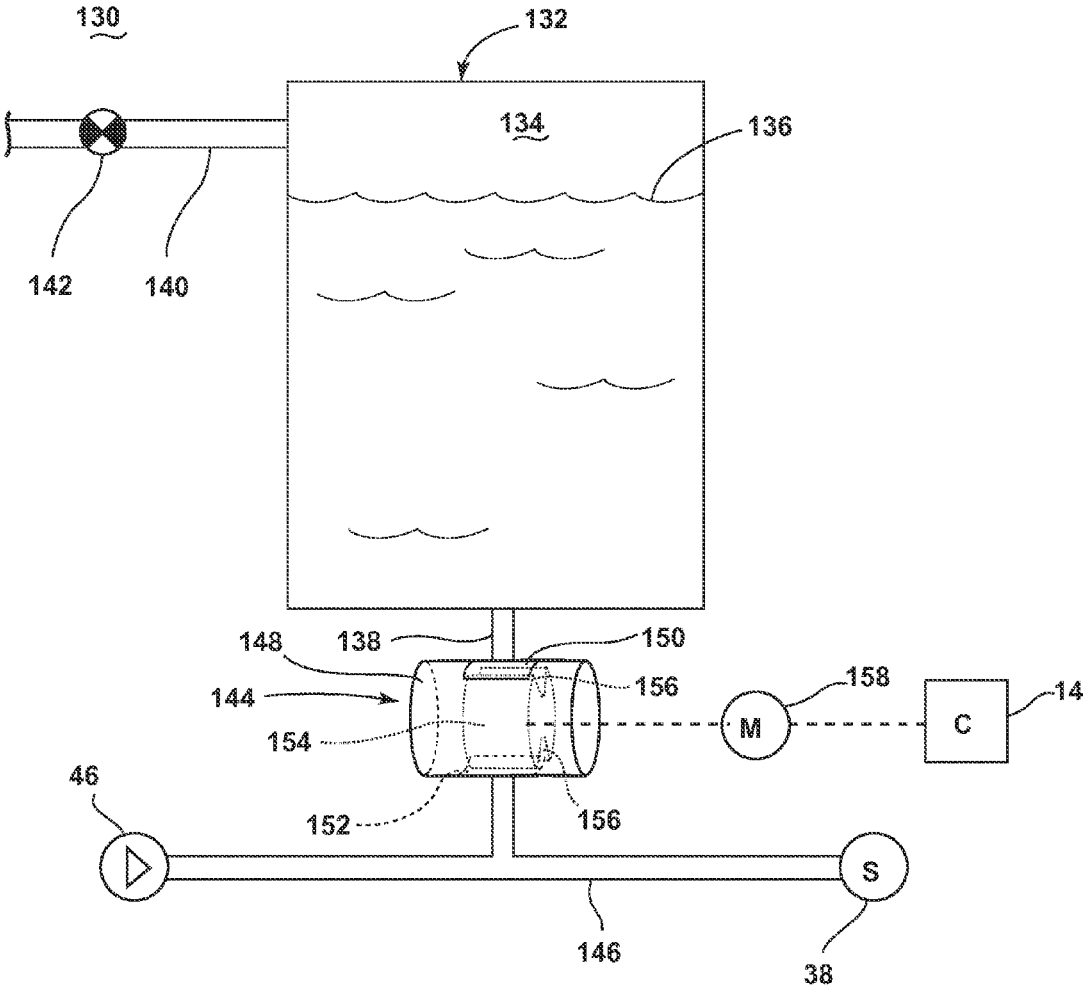
FIG. 6 is a schematic view of a dispensing system having a lifetime supply tank according to a fifth embodiment of the invention.

FIG. 6 is a schematic view of a dispensing system 130 having a lifetime supply reservoir, shown herein as a tank 132 according to a fifth embodiment of the invention. In the fifth embodiment, the lifetime supply tank 132 is a sealed container defining an interior chamber 134 for rinse aid 136 and includes a chemistry outlet 138 for rinse aid 136 and an air inlet 140 with a selectively openable closure, such as a one-way check valve 142, that will let air into the chamber 134 as rinse aid 136 is dispensed. A metering valve 144 on the outlet 138 can be configured to meter a small amount (for example, approximately 0.3 mL) of rinse aid 136 during a selected part of a cycle of operable. The metering valve 144 can be configured to dispense rinse aid 136 into a hose or conduit 146 extending between the sump 38 and the recirculation pump 46 so that rinse aid 136 can be supplied directly to recirculating wash liquid. Instead of being dispensed directly into the conduit 146, the rinse aid 136 can be dropped into a staging chamber or holding area in fluid communication with the conduit 146.

As shown herein, the metering valve 144 includes a valve barrel 148 with an inlet window 150 in communication with the outlet 138 and an outlet window 152 in communication with the conduit 146. The windows 150, 152 can be diametrically spaced from each other on the barrel 148. A valve body 154 is rotatably disposed in the valve barrel 148, and includes opposing cups 156, each of which can be sized to receive a single dose of rinse aid from the supply tank 132. A motor 158 can be used to rotate the valve body 154 to a desired position. For example, the motor 158, one example of which is a stepper motor, can rotate the valve body 154 approximately 180° during a selected part of a cycle of operation, via automatic control by the controller 14. As the cup 156 containing rinse aid 136 is brought into alignment with the outlet window 152, rinse aid 136 is dropped into the conduit 146 (or holding area). At the same time, the empty cup 156 is brought into alignment with the inlet window 150 to receive a dose of rinse aid 136 for the next cycle of operation.

While illustrated herein as comprising a liquid, the rinse aid may alternatively be supplied in solid or granular form. In the case of a solid rinse aid, such as a block of rinse aid, a mechanism for supplying a single dose of the rinse aid to the treating chamber 20 may be provided, such as a spray nozzle which is configured to project a spray of wash against the solid block to dissolve a single dose of rinse aid from the block per cycle. In the case of a granular rinse aid, a mechanism for supplying a single dose of granular rinse aid to the treating chamber 20 may be provided, such as a feed screw which imparts a feed motion to the granular rinse aid to dispense a single dose of rinse aid per cycle. Granular rinse aid can also be suitable for use with the fifth embodiment of the dispensing system 130 shown in FIG. 6.

The dishwasher 10 disclosed herein provides improved treating chemistry storage and dispensing. One advantage that may be realized in the practice of some embodiments of the described dishwasher 10 is that a lifetime supply of treating chemistry can be provided with the dishwasher. Unlike single use or bulk dispensing systems, the lifetime supply of treating chemistry never requires replenishment of the treating chemistry.

The invention may advantageously be applied to the rinse aid dispenser of the dishwasher 10. The expected lifetime of a household dishwasher is approximately 2,600 cycles (10 years×260 cycles per year). Currently, a single dose of rinse aid (approximately 3 mL) is dispensed per cycle. One of the problems with providing a lifetime supply of rinse aid is that, at this concentration, it would require a supply tank with a capacity of approximately 7.8 L, a volume too large to be accommodated in a dishwasher without increasing the size or footprint of the dishwasher beyond the current standardized dimensions. The present invention provides a super-concentrated rinse aid (i.e. approximately 8-10 times the normal concentration), thereby reducing the amount of rinse aid needed per cycle by a factor of 8-10 (to approximately 0.3-0.38 mL). Thus, the size of the rinse aid supply tank need only have a volume of around 0.8-1.0 L, which can be easily accommodated within a dishwasher having current standardized dimensions.

Current rinse aids have approximately 50-90% by weight of water. At larger concentrations, rinse aids are poisonous, so it is dangerous to have them accessible. The invention, which uses a super-concentrated rinse aid, provides the lifetime supply of rinse aid in a container which is non-refillable, inaccessible, and not openable by the user, in order to avoid any issues with coming into contact with the super-concentrated rinse aid.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A dishwasher for treating dishes according to an automatic cycle of operation, the dishwasher comprising:

a chassis defining an interior;

a tub located within the interior and at least partially defining a treating chamber for receiving dishes for treatment according to the cycle of operation;

at least one sprayer spraying liquid into the treating chamber;

a liquid recirculation system recirculating liquid from the treating chamber to the at least one sprayer and comprising a sump provided in the tub;

a lifetime supply reservoir comprising a tank located within the interior of the chassis and where the tank is concealed such that it is non-refillable, inaccessible, and not openable;

a lifetime supply of treating chemistry stored in the lifetime supply reservoir, wherein the lifetime supply of treating chemistry comprises a predetermined number of doses of treating chemistry for multiple cycles of operation and where the lifetime supply of treating chemistry is configured to last for an expected lifetime of the dishwasher based on a designed useful life of the dishwasher determined by a manufacturer; and a dispensing system fluidly coupled with the treating chamber and the tank of the lifetime supply reservoir, and configured to meter via a metering device a dose of treating chemistry from the lifetime supply of treating chemistry stored in the tank of the lifetime supply reservoir to the treating chamber during the cycle of operation.

2. The dishwasher of claim 1 wherein the treating chemistry comprises a rinse aid.

3. The dishwasher of claim 2 wherein the rinse aid comprises a super-concentrated rinse aid.

4. The dishwasher of claim 3 wherein the super-concentrated rinse aid comprises no greater than 45% by weight of water.

5. The dishwasher of claim 4 wherein the super-concentrated rinse aid comprises no greater than 10% by weight of water.

6. The dishwasher of claim 1 wherein the lifetime supply reservoir has a volume of no greater than one liter.

7. The dishwasher of claim 1 wherein the lifetime supply reservoir is located adjacent the sump.

8. The dishwasher of claim 1 wherein the lifetime supply reservoir is located within a space between the chassis and the tub.

9. The dishwasher of claim 8 wherein the treating chamber comprises a bottom wall and the lifetime supply reservoir is located underneath the bottom wall of the treating chamber.

10. The dishwasher of claim 7, further comprising a recirculation pump and a conduit fluidly coupling the sump to the recirculation pump and wherein the lifetime supply reservoir is in fluid communication with the conduit such that the treating chemistry can be supplied directly to recirculating wash liquid.

11. The dishwasher of claim 1 wherein the lifetime supply reservoir comprises an air inlet with a selectively openable closure for the air inlet configured to allow air into the lifetime supply reservoir as the treating chemistry is dispensed from the lifetime supply reservoir by the dispensing system.

12. The dishwasher of claim 1 wherein the metering device comprises a metering valve for selectively metering a single dose of treating chemistry from the lifetime supply reservoir.

13. The dishwasher of claim 12 wherein the dispensing system further comprises a dispensing pump and the dispensing pump is in fluid communication with the metering valve.

14. The dishwasher of claim 12 wherein the metering valve comprises a pressure-actuated valve.

15. The dishwasher of claim 12 wherein the metering valve comprises a moveable valve body disposed within a valve barrel.

16. The dishwasher of claim 15 wherein the dispensing system further comprises a motor coupled with the valve body for rotating the valve body within the valve barrel.

17. The dishwasher of claim 1 wherein the lifetime supply reservoir comprises a sealed, collapsible container.

18. The dishwasher of claim 1 wherein the dispensing system further comprises a user-accessible portion having a compartment configured to store another treating chemistry to be dispensed during the cycle of operation.

19. The dishwasher of claim 10, further comprising a holding area in fluid communication between the tank of the lifetime supply reservoir and the conduit and where the metering of the dose comprises initially metering to the holding area and final metering to the conduit.

20. A dishwasher for treating dishes according to an automatic cycle of operation, the dishwasher comprising:

a chassis defining an interior;

a tub located within the interior and at least partially defining a treating chamber for receiving dishes for treatment according to the cycle of operation;

a cover mounted to the chassis and moveable between an opened position wherein a user of the dishwasher may access the treating chamber, and a closed position wherein the cover closes an open face of the treating chamber;

a lifetime supply reservoir comprising a sealed tank located within the interior of the chassis and exteriorly of the tub such that the sealed tank is concealed and inaccessible by a user of the dishwasher in both the opened and closed positions of the cover;

a lifetime supply of treating chemistry stored in the lifetime supply reservoir, wherein the lifetime supply of treating chemistry comprises a predetermined number of doses of treating chemistry for multiple cycles of operation configured to last an expected lifetime of the dishwasher based on a designed useful life of the dishwasher as determined by a manufacturer; and a dispensing system fluidly coupled with the treating chamber and the sealed tank of the lifetime supply reservoir, and configured to meter a dose of treating chemistry from the lifetime supply of treating chemistry stored in the lifetime supply reservoir to the treating chamber during the cycle of operation.

* * * * *